US007775859B2

(12) United States Patent
May et al.

(10) Patent No.: US 7,775,859 B2
(45) Date of Patent: Aug. 17, 2010

(54) LOW PROFILE RUCKERS CAPABLE OF RUCKING FIXED DIAMETER COVERINGS AND ASSOCIATED DEVICES, METHODS, SYSTEMS AND COMPUTER PROGRAM PRODUCTS

(75) Inventors: Dennis J. May, Pittsboro, NC (US); Samuel D. Griggs, Raleigh, NC (US); Matthew Lowder, Durham, NC (US); Thomas E. Whittlesey, Apex, NC (US)

(73) Assignee: Tipper Tie, Inc., Apex, NC (US)

( * ) Notice: Subject to any disclaimer, the term of this patent is extended or adjusted under 35 U.S.C. 154(b) by 1026 days.

(21) Appl. No.: 11/458,158

(22) Filed: Jul. 18, 2006

(65) Prior Publication Data

US 2007/0028565 A1 Feb. 8, 2007

Related U.S. Application Data

(60) Provisional application No. 60/702,168, filed on Jul. 25, 2005.

(51) Int. Cl.
*A22C 11/00* (2006.01)

(52) U.S. Cl. ..... 452/30

(58) Field of Classification Search ..... 452/30–35, 452/37–39, 46–48, 51
See application file for complete search history.

(56) References Cited

U.S. PATENT DOCUMENTS

| | | | | |
|---|---|---|---|---|
| 3,389,533 | A | 6/1968 | Tipper et al. | |
| 3,499,259 | A | 3/1970 | Tipper et al. | |
| 4,683,700 | A | 8/1987 | Evans et al. | |
| 4,766,713 | A | 8/1988 | Evans et al. | |
| 4,885,821 | A * | 12/1989 | Farkonas | 452/29 |
| 4,924,552 | A * | 5/1990 | Sullivan | 452/24 |
| 5,056,293 | A | 10/1991 | Richards et al. | |
| 5,161,347 | A | 11/1992 | May et al. | |
| 5,211,599 | A * | 5/1993 | Stanley | 452/37 |
| 5,273,481 | A | 12/1993 | Sullivan | |
| 5,495,701 | A | 3/1996 | Poteat et al. | |
| 5,514,029 | A * | 5/1996 | Schutz | 452/35 |
| 5,573,454 | A * | 11/1996 | Fox et al. | 452/29 |

(Continued)

FOREIGN PATENT DOCUMENTS

| | | |
|---|---|---|
| WO | WO2005/032759 | 4/2005 |

OTHER PUBLICATIONS

International Search Report and Written Opinion dated Aug. 3, 2007 for corresponding PCT application No. PCT/US06/28204.

*Primary Examiner*—Thomas Price
(74) *Attorney, Agent, or Firm*—Myers Bigel Sibley & Sajovec, P.A.

(57) ABSTRACT

Methods, apparatus and associated devices for rucking sleeves of covering material onto a chute body include a plurality of spaced apart rotatable wheels having a primary axis of movement, wherein, in operation, the plurality of wheels have an automated stroke cycle whereby each is configured to travel inwardly a distance sufficient to snugly abut an outer surface of a chute body and remain in contact with the chute body while the wheels travel in a first direction about the primary axis of movement and in an opposing second direction about the primary axis of movement.

25 Claims, 13 Drawing Sheets

U.S. PATENT DOCUMENTS 5,586,424 A 12/1996 Chen et al.
6,669,545 B1 * 12/2003 Hergott et al. ..... 452/33
7,507,150 B2 * 3/2009 Stall et al. ..... 452/32
7,604,531 B2 * 10/2009 Hanten ..... 452/48
2005/0039419 A1 2/2005 Griggs et al.

* cited by examiner

LOW PROFILE RUCKERS CAPABLE OF RUCKING FIXED DIAMETER COVERINGS AND ASSOCIATED DEVICES, METHODS, SYSTEMS AND COMPUTER PROGRAM PRODUCTS

RELATED APPLICATION

This application claims the benefit of priority to U.S. Provisional Application Ser. No. 60/702,168, filed Jul. 25, 2005, the contents of which are hereby incorporated by reference as if recited in full herein.

FIELD OF THE INVENTION

The present invention relates to ruckers that can be used to load sleeves of material onto product chutes that, in operation, hold and release the covering material to package products therein, and may be particularly suitable for fixed diameter covering materials.

BACKGROUND OF THE INVENTION

Certain types of commodity and/or industrial items can be packaged by placing the desired product(s) in a covering material, then applying a closure clip or clips to end portions of the covering material to secure the product(s) therein. For non-flowable piece goods, the piece goods can be held individually in a respective clipped package, or as a group of goods in a single package. The covering material can be any suitable material, typically a casing and/or netting material.

Generally described, when packaging a piece good product in netting, the product is manually pushed through a netting chute. The product can include, by way of example, a non-flowable semi-solid and/or solid object such as a meat product, including whole or half hams, turkey, chicken, and the like. The netting chute holds a length of a netting sleeve over the exterior thereof. A first downstream end portion of the netting is typically closed using a first clip. As the product exits the netting chute, it is covered with the netting. An operator can then orient the product inside the netting between the discharge end of the chute and the clipped first end portion of the netting. The operator can then pull the netting so that the netting is held relatively tight (typically stretched or in tension) over the product. The operator then uses his/her hands to compress or gather the open end of the netting (upstream of the product), then manually applies a clip to the netting, typically using a Tipper Tie® double clipper apparatus. A clip attachment apparatus or "clippers" are well known to those of skill in the art and include those available from Tipper Tie, Inc., of Apex, N.C., including product numbers Z3214, Z3202, and Z3200. Examples of clip attachment apparatus and/or packaging apparatus are described in U.S. Pat. Nos. 3,389,533; 3,499,259; 4,683,700; 5,161,347, and co-pending U.S. patent application Ser. No. 10/951,578 (Pub. No. US-2005-0039419-A1); the contents of these documents are hereby incorporated by reference as if recited in full herein.

The double clipper concurrently applies two clips to the netting proximate the open (upstream) end of the package. One clip defines the first end portion of the next package and the other defines the trailing or second end portion of the package then being closed. A cutting mechanism incorporated in the clipper apparatus can sever the two packages before the enclosed package is removed from the clipper apparatus. U.S. Pat. No. 4,766,713 describes a double clipper apparatus used to apply two clips to a casing covering. U.S. Pat. No. 5,495,701 proposes a clipper with a clip attachment mechanism configured to selectively fasten a single clip or two clips simultaneously. The mechanism has two punches, one of which is driven directly by a pneumatic cylinder and the other of which is connected to the first punch using a pin and key assembly. The pin and key assembly allows the punches to be coupled or decoupled to the pneumatic cylinder drive to apply one single clip or two clips simultaneously. U.S. Pat. No. 5,586,424 proposes an apparatus for movement of U-shaped clips along a rail. The apparatus includes a clip feed for advancing clips on a guide rail and the arm is reciprocally driven by a piston and cylinder arrangement. The contents of each of these patents are hereby incorporated by reference as if recited in full herein.

To place a sleeve of the selected covering on the product chute, an automated or semi-automated rucker may be employed. This type of process is often described by those of skill in the art as "shirring" or "rucking". In the past, ruckers have been configured to reciprocate a netting tube or chute vertically to load the netting. In some prior art devices, the netting is stretched over the chute and stationary spring-loaded fingers circumferentially surround the tube and engage with openings in netting to pull segments of netting over the outer surface of the netting chute so that the netting covers a substantial portion of the length of the chute. In operation, the fingers flex from a normal horizontal orientation to contact the netting and carry the netting down during an upward stroke of the netting chute and slide over the netting during the downward stroke of the chute. An example of a prior art rucker that uses circumferentially mounted paddles that flex downward when the chute travels down to avoid the netting is described in U.S. Pat. No. 5,273,481, the contents of which are hereby incorporated by reference as if recited in full herein.

U.S. Pat. No. 4,924,552 proposes another example of a net rucker device. This type of device employs two opposing wheels, each with a concave receiving cavity which receives a portion of a temporary tubular carrier sleeve. The wheels are rotated to pull netting from a roll onto a carrier sleeve as the carrier sleeve is translated vertically.

Unfortunately, conventional ruckers may not be suitable for shirring one or more of fixed diameter materials, delicate compression fit netting, or materials that may be susceptible to breaking and/or have less resilience than conventional elastic open weave netting types. In addition, conventional ruckers may not be suitably configured to operate with non-cylindrical product chutes, may require undue space allocations in a plant (particularly for longer netting chutes) and/or may not operate with desired speed.

SUMMARY OF EMBODIMENTS OF THE INVENTION

Embodiments of the present invention provide alternative ruckers that may resolve one or more of the above-identified deficiencies of conventional net ruckers. The ruckers may be low-profile, capable of rucking fixed diameter covering materials such as delicate and/or relatively inelastic covering materials, may have increased operational speed and/or able to accommodate non-circular chute profiles.

Some embodiments are directed to apparatus for rucking sleeves of covering material onto a chute body. The apparatus can include a plurality of spaced apart rotatable wheels having a primary axis of movement. In operation, the plurality of wheels have an automated stroke cycle whereby each is configured to travel inwardly a distance sufficient to snugly abut an outer surface of a chute body and remain in contact with the chute body while the wheels travel in a first direction about the primary axis of movement and in an opposing second direction about the primary axis of movement.

In some embodiments, the wheels rotate as they travel in the second direction but do not rotate as they travel in the first direction. The apparatus may also include a variable speed drive in communication with the wheels so that the wheels can move at first speed in the first direction of travel about the primary axis of movement and at a second speed different from the first speed in the second direction of travel about the primary axis of movement.

Other embodiments are directed to automated methods of rucking sleeves of material onto a product chute. The methods include: (a) pinching covering material between a set of spaced apart rotatable wheels and a chute body; (b) moving the wheels in a first primary direction relative to the chute body as they pinch the covering material against the chute body to pull a length of covering material over the chute body; then (c) rotatina the wheels while the wheels move in a second opposing primary direction relative to the chute body to pull additional lengths of the covering material onto the chute body.

In some embodiments, the method may also include holding the chute body stationary during the moving and rotating steps.

Other embodiments are directed toward computer program products for operating an automated rucking apparatus. The computer program product includes a computer readable storage medium having computer readable program code embodied in the medium. The computer-readable program code includes: (a) computer readable program code that is configured to direct the movement of a drive system that translates a plurality of spaced apart wheels in concert in a first axial direction and in a second axial direction; and (b) computer readable program code configured to initiate rotation of the wheels when the wheels move in the second direction.

In particular embodiments, the computer program product may include computer readable program code configured to adjust the (non-rotational) speed of movement of the wheels so that the wheels move faster in the first direction than in the second direction.

Other embodiments are directed to elongate tapered generally (typically substantially) conical loading caps for ruckers. In some embodiments, the loading cap may have a non-circular perimeter shape at its lower end.

Still other embodiments are directed to loading caps for a rucker apparatus. The loading caps include an elongate generally conical tapered member adapted to mount to a product chute body.

In some embodiments, the loading cap can have one end portion with a non-circular cross-sectional perimeter shape. In some particular embodiments, the loading cap can have a frustoconical end portion that tapers over a distance to a non-circular end portion.

These and other objects and/or aspects of the present invention are explained in detail in the specification set forth below.

DESCRIPTION OF EMBODIMENTS OF THE INVENTION

Figure 1B:
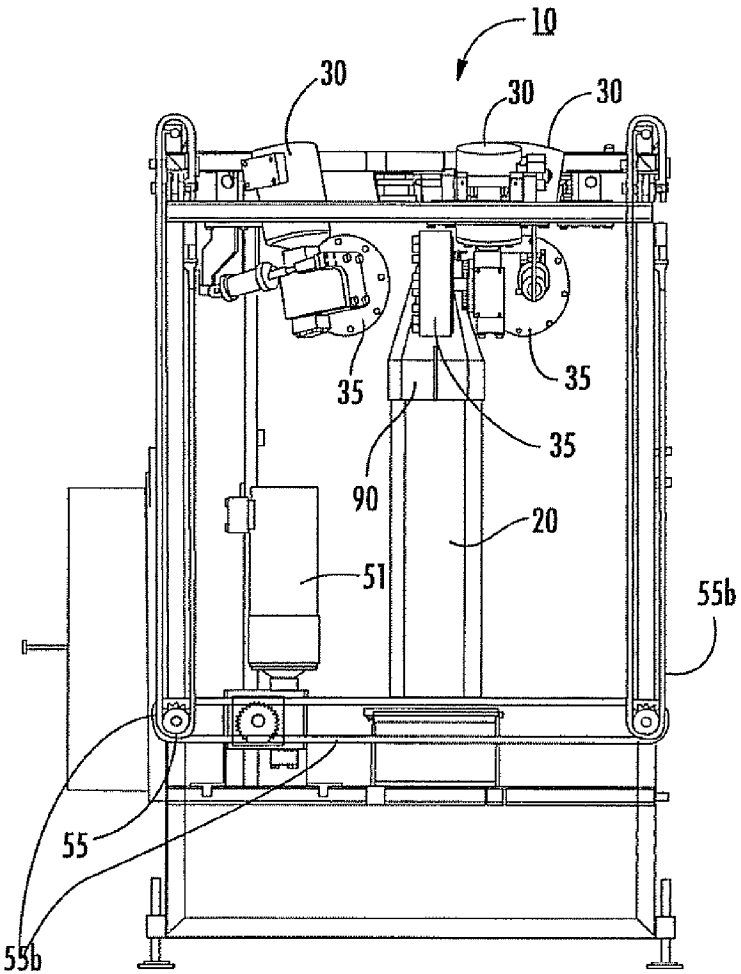
FIG. 1B is a side view of the rucker shown in FIG. 1A, but with drive belts and a loading cap shown in position according to embodiments of the present invention.

The present invention will now be described more fully hereinafter with reference to the accompanying figures, in which embodiments of the invention are shown. This invention may, however, be embodied in many different forms and should not be construed as limited to the embodiments set forth herein. Like numbers refer to like elements throughout. In the figures, certain layers, components or features may be exaggerated for clarity, and broken lines illustrate optional features or operations, unless specified otherwise. In addition, the sequence of operations (or steps) is not limited to the order presented in the claims unless specifically indicated otherwise. Where used, the terms "attached", "connected", "contacting", "coupling" and the like, can mean either directly or indirectly, unless stated otherwise. The term "concurrently" means that the operations are carried out substantially simultaneously.

In the description of the present invention that follows, certain terms are employed to refer to the positional relationship of certain structures relative to other structures. As used herein, the term "front" or "forward" and derivatives thereof refer to the general or primary direction that the sleeve or material is loaded onto the chute body; this term is intended to be synonymous with the term "downstream," which is often used in manufacturing or material flow environments to indicate that certain material traveling or being acted upon is farther along in that process than other material. Conversely, the terms "rearward" and "upstream" and derivatives thereof refer to the directions opposite, respectively, the forward and downstream directions.

As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

The term "automated" and "automatic" refers to operations that are carried out without requiring manual assistance and are typically carried out using electronic controls and programmatic (computer) direction. The terms also contemplate the use of manual activation of the automatic operations. The term "frame" means a generally skeletal structure used to support one or more assemblies, modules and/or components. The term "modular" means that a subassembly is designed with standardized dimensions, mounting features and/or configurations for interchangeable use with replacement modules of the same or similar type and/or other selected different modules. The term "generally conical" describes an elongate body having a smaller first end that tapers outwardly over its distance to a larger second end. The term "generally conical" includes, but is not limited to, frustoconical shapes.

The present invention is particularly suitable for providing covering materials that may employ closure clips to enclose discrete objects in the covering material. The covering material may be natural or synthetic and may be a casing material that can be sealed about a product or may be netting. The casing can be any suitable casing (edible or inedible, natural or synthetic) such as, but not limited to, collagen, cellulose, plastic, elastomeric or polymeric casing. The term "netting" refers to any open mesh material formed by any means including, for example, knotted, braided, extruded, stamped, knitted, woven or otherwise. Typically, the netting is configured so as to be stretchable in both axial and lateral directions, but fixed diameter netting or covering may also be used. In some embodiments, the covering material is a fixed diameter or compression netting material (known as "fixed diameter net") comprising cotton, available from Jif Pak (Vista, Calif.) and PCM (Greenville, S.C.). In some embodiments, the covering material is substantially non-elastic or frangible when laterally stretched more than 10%, and typically cannot be stretched, without unacceptable degradation, more than 5% beyond the bounds of the underlying target chute. In some embodiments, the covering can be a generally closed weave delicate and/or relatively inelastic material (at least in the non-axial dimension).

Netting or other covering material may be used to package discrete meat products such as loaves of meat, boned ham, spiral sliced ham, deboned ham, turkey, turkey loaves held in molds, or other meat or items, directly or with the items held in subcontainers and/or wraps such as molds, trays, boxes, bags, absorbent or protective sheets, sealant, cans and the like. Other embodiments of the present invention may be directed to package other types of food such as cheese, bread, fruit, vegetables, and the like. Examples of non-food items that may be packaged using embodiments of the present invention include living items such as flora, trees, and the like, as well as inanimate objects. Additional examples of products include discrete, semi-solid or solid non-flowable objects such as firewood, pet food (typically held in a container if the wet type), recreational objects (such as toy or game balls), or other solid or semi-solid objects. The product may be packaged for any suitable industry including horticulture, aquaculture, agriculture, or other food industry, environmental, chemical, explosive, or other application. Netting may be particularly useful to package ham or turkeys, manufactured hardware such as automotive parts, firewood, explosives, molded products, and other industrial, consumable, and/or commodity items.

Embodiments of the present invention may be particularly suitable for operating with relatively delicate, substantially inelastic (at least in the radial direction) netting, such as cotton fiber fixed diameter coverings that may be configured to hold large meat products, such as meat products weighing over 20 pounds, typically about 35-40 pounds. In some embodiments, the sleeves of covering placed on the product chute can be greater than or equal to about 120 feet in length and sufficient to enclose between about 50-80 discrete hams, and typically about 60 discrete hams.

In some embodiments, the covering is a closed weave material comprising cotton that is used to control the size of ham steaks to provide consistency in steak size, ham to ham. The tight weave of the covering is such that there is very little stretch (i.e., fixed diameter) such that the cross-sectional size (when stretched) is very close to that of the chute.

Generally stated, embodiments of the present invention are directed at automating the rucking of covering materials onto chutes that are used to package piece goods or discrete items by forcing the goods through a product chute and wrapping or enveloping the objects at the other end of the product chute in a covering material, such as netting, as one or more of the goods exit the chute. In some embodiments, after the product (s) is enclosed in the packaging, a clip(s) or other attachment means can be automatically or semi-automatically applied to the covering material to thereby close a leading and/or trailing edge of the covering and hold the object or objects inside of the covering material. As noted above, clippers are available from Tipper Tie, Inc., of Apex, N.C. Examples of suitable clips include metallic generally "U"-shaped clips available from Tipper Tie, Inc., in Apex, N.C. Other clips, clip materials and clip configurations or closure means may also be used.

Figure 1A:
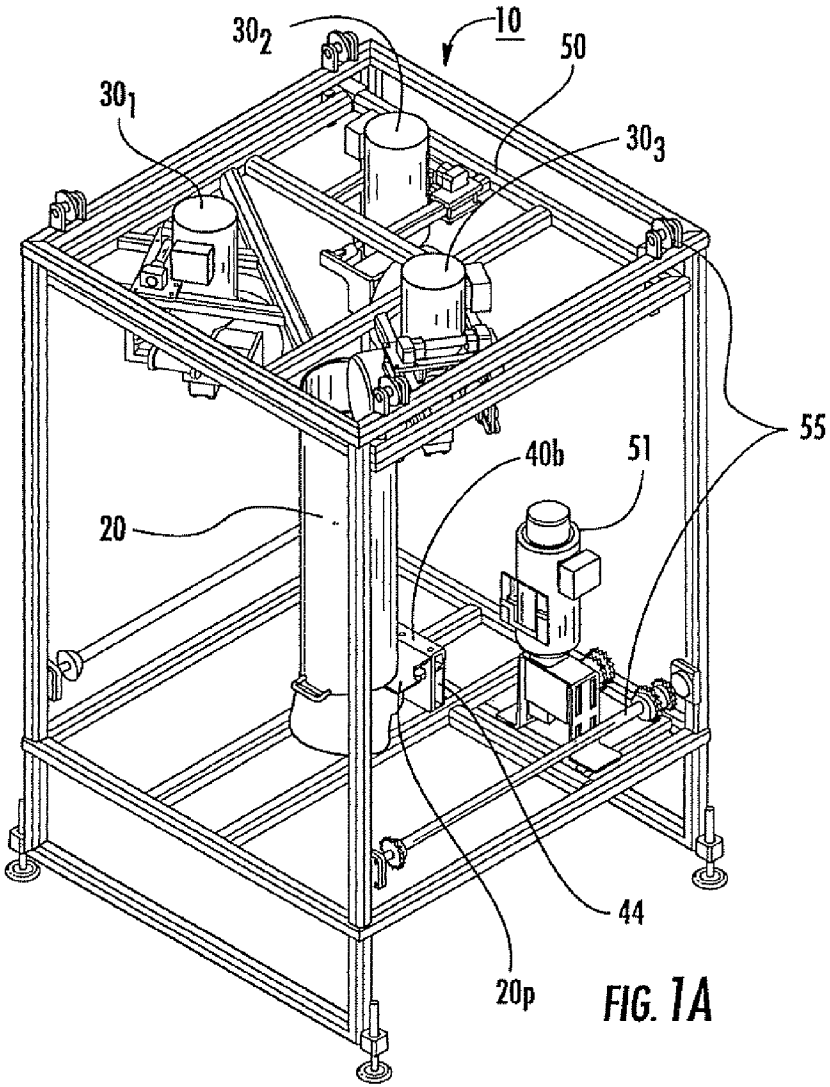
FIG. 1A is a front perspective view of a rucker with a frame but with housing walls and certain components removed according to embodiments of the present invention.
Figure 2A:
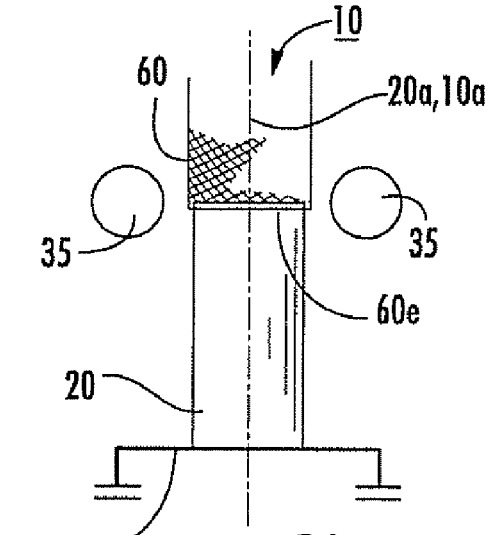
FIGS. 2A-2E are schematic front view illustrations of serial rucker operations according to embodiments of the present invention.

Referring now to FIG. 1A, an exemplary rucker apparatus 10 is shown. The rucker 10 is configured to hold a product chute 20 therein. The rucker 10 can include a mounting bracket 40*b* that holds the chute 20 in a desired position with the axial centerline of the chute 20*a* substantially aligned with the axial center line of the apparatus (wheels) 10*a* (FIG. 2A). In the embodiment shown, the chute 20 includes a mounting plate 20*p* that engages an air-actuated locking member 44 to help secure the chute 20 in position.

The rucker 10 can be configured to operate with different length and differently shaped product chutes 20 as will be discussed farther below. The rucker 10 includes a plurality of spaced apart wheel assemblies 301, 302, 303. Although shown as three wheel assemblies 301, 302, 303, more or fewer wheel assemblies may be used. Referring to FIG. 4, the wheel assemblies 301, 302, 303 each include a respective rotatable wheel 35 that has an actuation cylinder 38 that pivotably moves the wheel 35 into snugly abutting contact with the chute body 20. The actuation cylinders 38 can have air or hydraulic drives. The rucker 10 can include a chute platform 40 (FIGS. 2A-2E) that is typically configured to remain fixed (substantially stationary in at least the axial direction) during the rucking or shirring operation. The wheel assemblies 301, 302, 303 are mounted to a rail 50 that can move up and down about a primary (wheel) movement axis The rail 50 can be in communication with a drive system 55 (shown in FIGS. 1A and 4A-6 with the cables, chains, or belts removed for clarity) comprising an AC motor 51. FIG. 1B illustrates examples of a belt drive 55*b* in communication with the sprockets 55 and motor 51 that move the rail 50 up and down in concert. Suitable drive systems are well known to those of skill in the art.

Figure 2B:
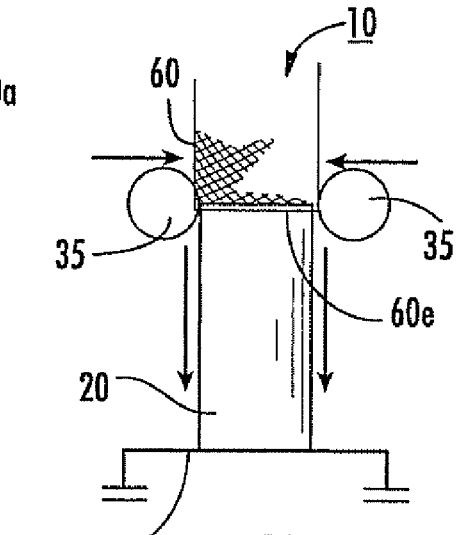
Figure 2C:
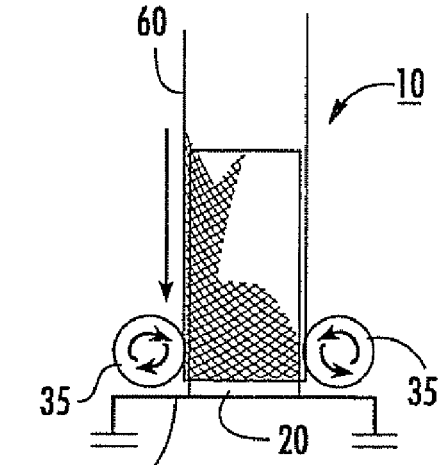

Serial operations can be generally described with reference to FIGS. 2A-2E. As shown in FIG. 2A, at least two wheels are in a home position where they do not contact the chute body 20. A leading edge 60*e* of a sleeve of material 60 can be manually or automatically placed on a first end portion of the chute body 20. The wheels 35 can move, in concert or independently, temporally inward to snugly abut the chute body as shown in FIG. 2B to pinch the covering material 60 between the wheels 35 and the chute 20. Next, as shown in FIG. 2C, the wheels 35 remain snugly abutting the chute and pull the sleeve of material down along a loading length of the chute 20. The wheels 35 are typically not rotating during the down stroke. However, the wheels 35 may turn at a relatively slow rotational speed (slower than they would typically turn during the upstroke). Once at the desired lower stop location, the wheels 35 can be activated to rotate (the motor can be turned on). Alternatively, the wheels 35 can rotate before they reach the lower stop. The upper and lower stop locations can be electronically adjustable using location sensors on the frame of the apparatus 10 and/or wheel drive system and/of programmatic input and direction to allow for loading of different length or shaped chutes.

Figure 2D:
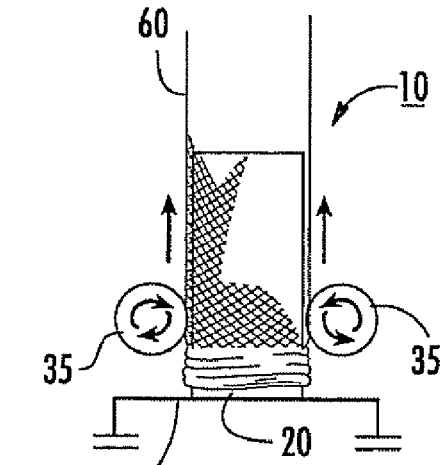
Figure 2E:
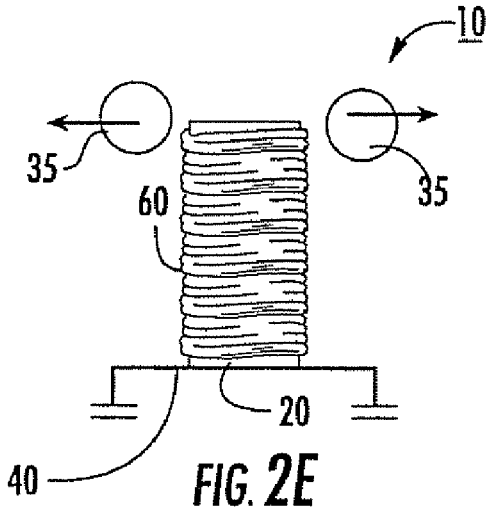

As shown in FIG. 2D, during the upstroke the wheels 35 rotate as the wheels travel upward at a speed sufficient to allow the wheels 35 to continuously pull the desired sleeve segment about the chute. As shown in FIG. 2E, the wheels 35 continue to a desired upper location (which can be proximate their start location) and retract outward to a home position to thereby load the chute 20 with a shirred length of sleeve material distributed over a desired loading length of the chute 20. In some embodiments, the shirring operation can comprise a single up and down stroke of the wheels 35 to load the chute 20. The chute 20 is typically stationary, at least while the wheels 35 are moving. However, the chute 20 may be configured to also translate. By configuring the chute to be stationary, a lower profile apparatus can be used as the chute 20 does not need to move relative to the apparatus. This may be particularly useful for longer chute lengths.

Figure 13:
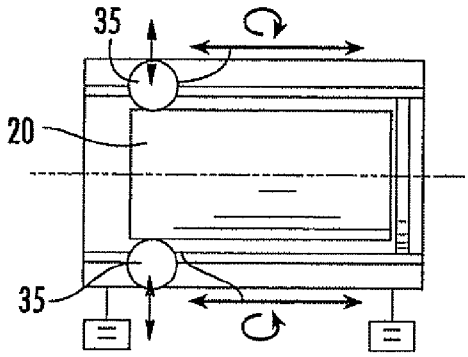
FIG. 13 is a schematic illustration of an alternative translation orientation of the wheels according to embodiments of the present invention.

It is noted that although the movement of the wheels 35 is described with respect to an upward and downward stroke and a vertical primary axis movement, the primary axis of movement can be otherwise oriented such as horizontal (see, e.g., FIG. 13) or angular. In addition, although described as starting pulling the sleeve of material from a first (upward) end of the chute 20, the operations may be carried out in the reverse.

Figure 3:
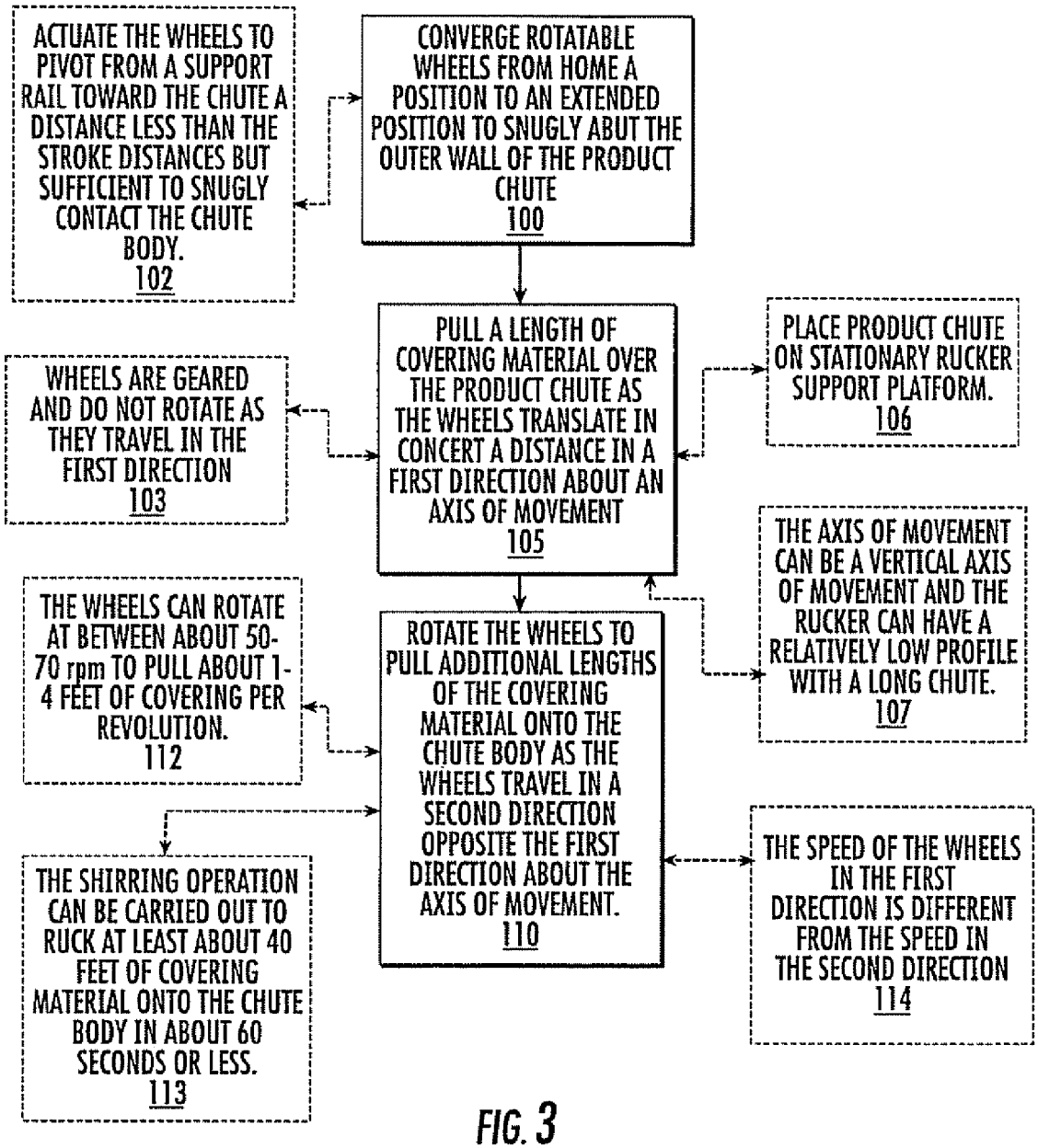
FIG. 3 is a flow chart of operations that can be used to carry out methods of rucking covering materials onto a chute according to embodiments of the present invention.

FIG. 3 is a flow chart of operations that can be used to carry out the rucking or shirring process. As shown, rotatable wheels can converge from respective (retracted) spaced apart home locations to snugly abut the chute body (block 100). A length of covering material is pulled over the product chute as the wheels translate in concert a distance in a first direction about a primary axis of movement (block 105). The wheels are rotated to pull additional lengths of the covering material onto the chute body as the wheels travel in a second direction opposite the first direction about the primary axis of movement (block 110).

The chute may reside on a stationary support platform (block 106). The primary axis of movement may be a vertical axis of movement and the rucker may have a low profile, whether a long or short chute (block 107). That is, the apparatus can be adapted to accept chutes having different lengths and/or shapes, typically lengths between about 4-10 feet (with the longer chutes being 6-10 feet). In some embodiments, the apparatus can have a height H (FIG. 4A) that is about 8 feet or less, typically about 6.5 feet or less, and is configured to accept product chutes having a target loading length that is between about 3-6 feet and more typically 3-4 feet. The axial or linear speed of the wheels can be different in each primary linear and/or axial direction (block 114). Similarly, the rotational speed can vary along a single direction and/or between directions. Each wheel 35 typically rotates and moves at the same speed as the others in operation. In addition, the wheels 35 can rotate toward the chute. That is the wheels 35 may be configured to cooperatively rotate either clockwise or counterclockwise to pull the netting onto the chute, depending on their mounting orientation with respect to the chute 20 (see, e.g., FIGS. 2C, 2D).

In some embodiments the wheels 35 can be actuated to pivot from a support rail toward the chute a distance that is less than the respective stroke distances but sufficient to snugly abut the chute (block 102). The wheels can be geared and configured not to rotate as they travel in the first direction (block 103). The wheels can rotate at between about 50-70 rpm to pull about 1-4 feet of covering (typically about 3 feet) per revolution (block 112). Typically, the wheels rotate at between about 58-60 rpm. The shirring operation can be carried out to ruck about 40 feet of covering material onto the chute body in about 60 seconds or less (block 113). Typically, the shirring operation can be carried out to ruck a single sleeve and/or about 120 feet of covering material onto the chute body in about 40 seconds or less.

Figure 4B:
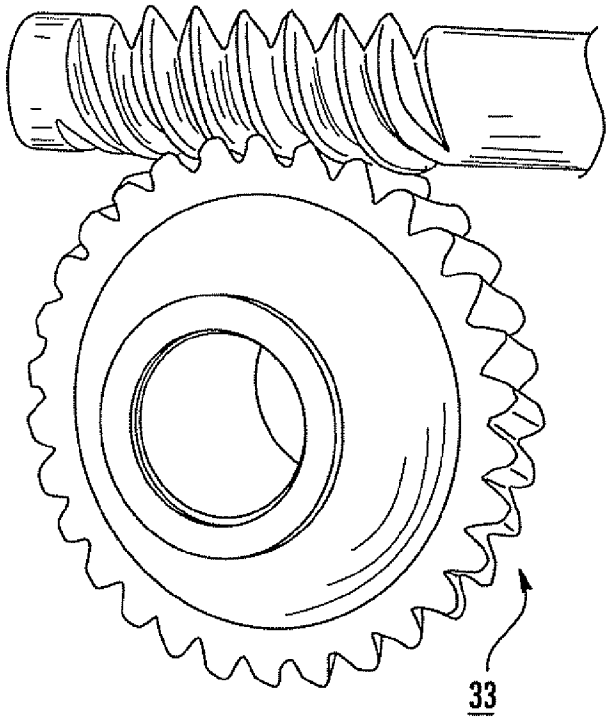
FIG. 4B is a side perspective view of an exemplary worm gear that may be used to power the wheels shown in FIG. 4A according to embodiments of the present invention.
Figure 4A:
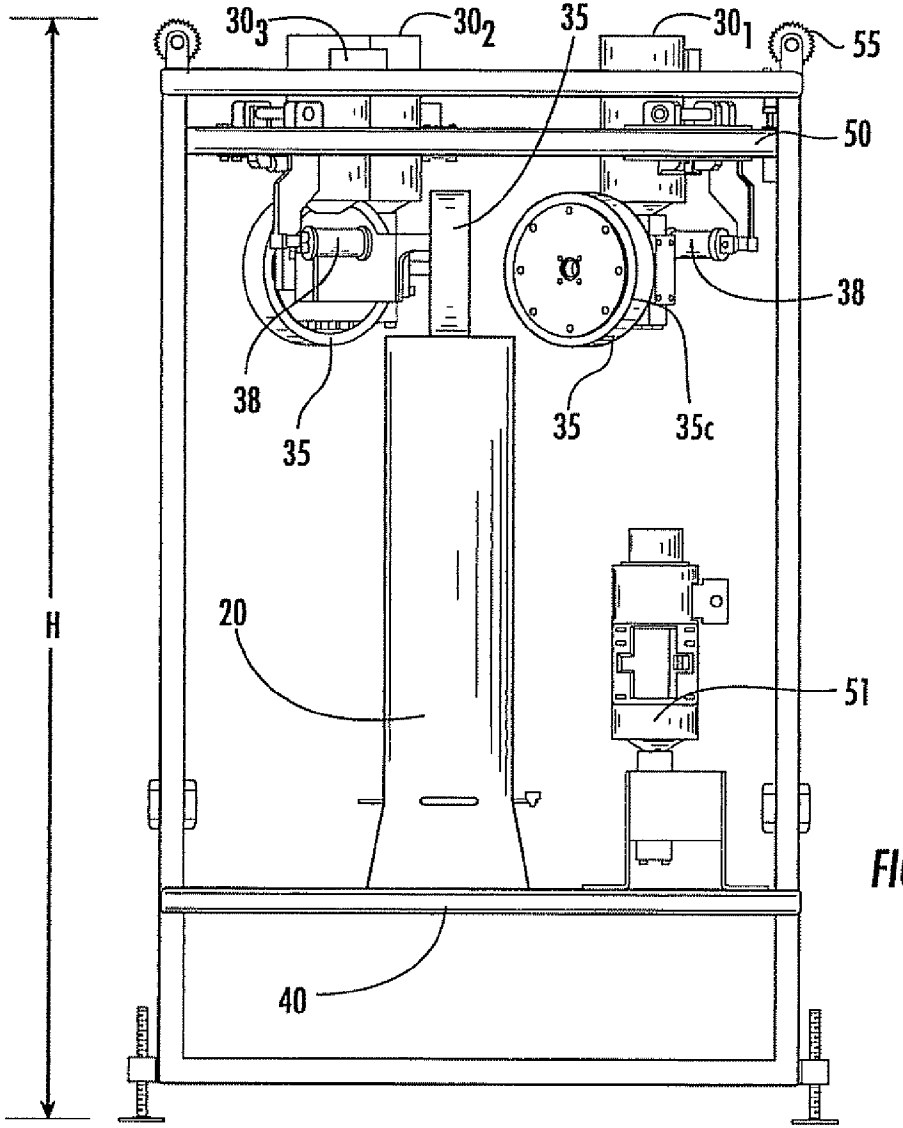
FIG. 4A is a side perspective view of the nicker shown in FIG. 1A with the wheels at a home position according to embodiments of the present invention.
Figure 4C:
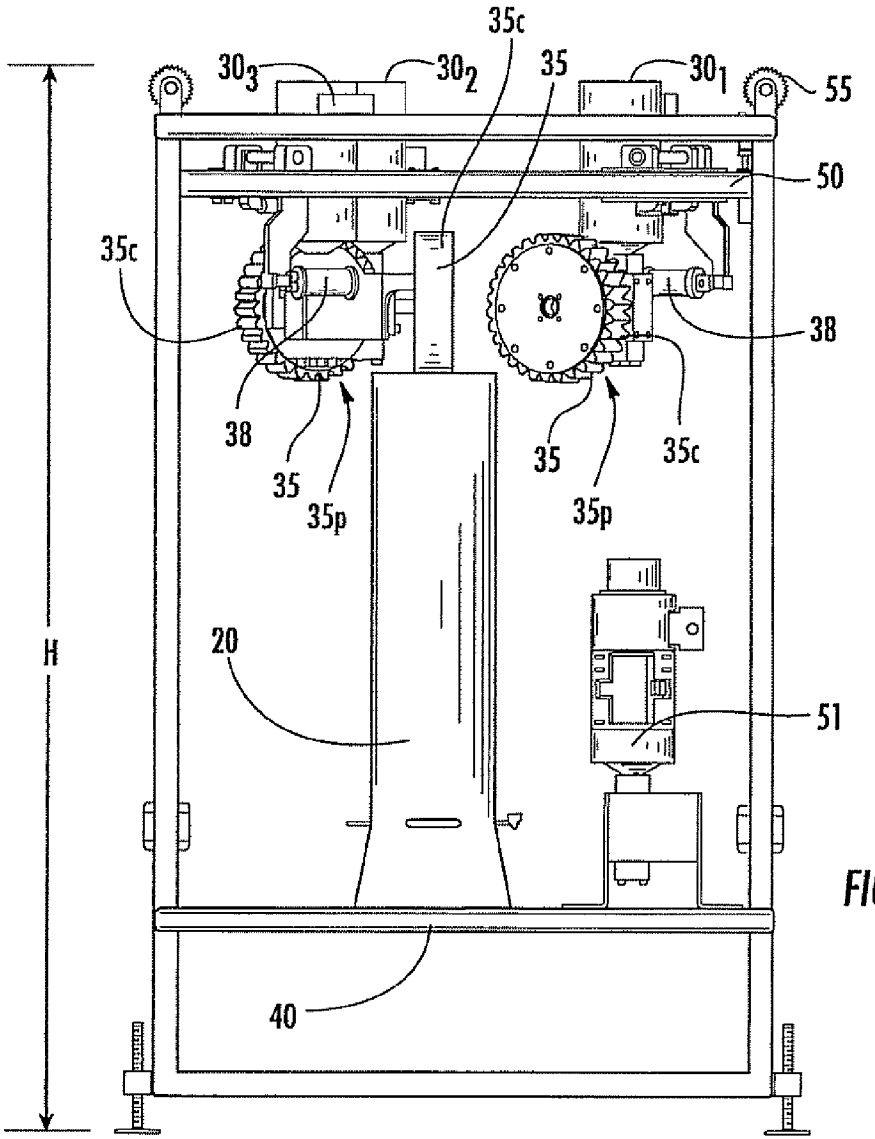
FIG. 4C is a side perspective view of the rucker shown in FIG. 4A, illustrating an exemplary alternate wheel configuration with a patterned contact surface according to embodiments of the present invention.
Figure 5:
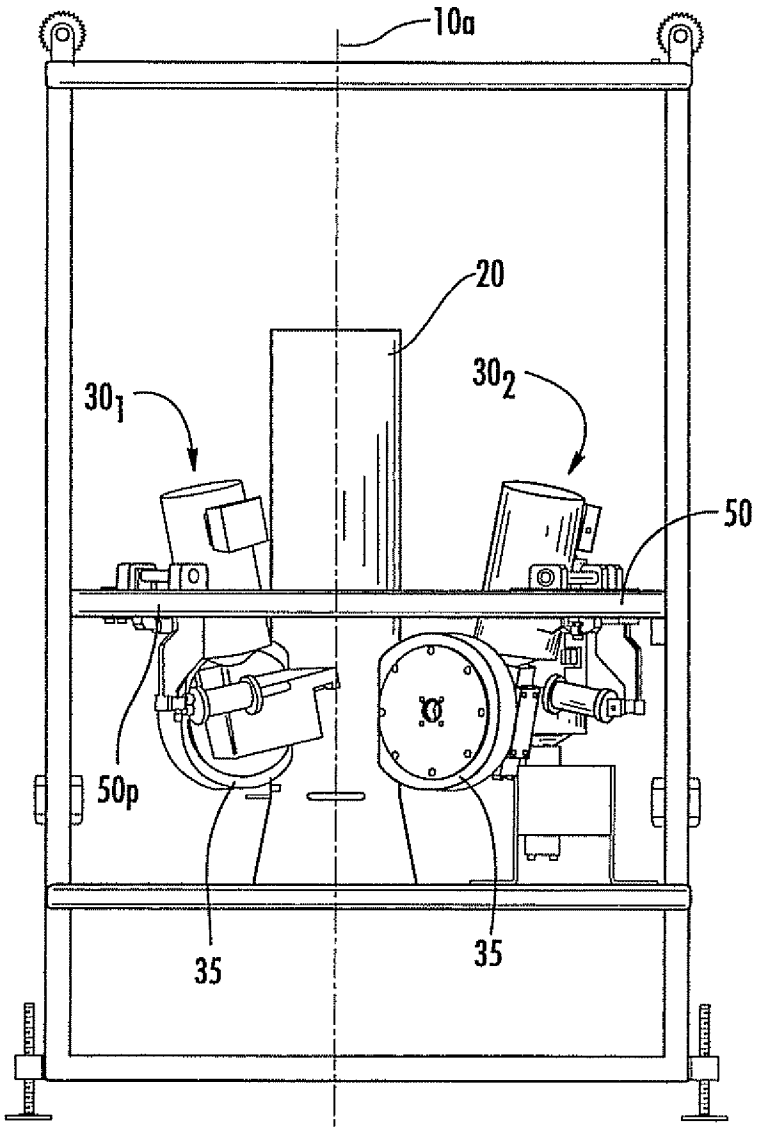
FIG. 5 is a side view of the rucker shown in FIG. 1A with the wheels moved to a lower portion of the chute body according to embodiments of the present invention.

Referring to FIGS. 4A and 5, the wheels 35 can include an elastomeric or rubber outer contact surface 35*c* with sufficient frictional properties to be able to pull the covering material 60 without being unduly abrasive to the target covering material (particularly where fixed diameter or delicate covering materials are used). The outer surface can be provided by a replaceable annular or sleeve member. The wheels 35 can include a generally planar outer surface as shown in FIG. 4A and/or brushes, fibers, or other surface configurations. FIG. 4C illustrates that one or more of the wheels 35 may have a patterned 35*p* contact surface 35*c* for increased Dripping. The pattern 35*p* can be regularly spaced lateral slots about the circumference or a more complex pattern such similar to tire tread patterns (not shown). Each wheel 35 can have the same or different wheel and/or wheel contact surface configuration/pattern. In particular embodiments, as shown for example in FIGS. 4C and 6B, two of the wheels 35 can have a patterned wheel contact surface 35*c* while the third wheel 35 (typically the one facing the planar portion of the chute body) may be non-patterned. The brushes (not shown) may be particularly suitable for open weaves such as elastic open netting materials. The wheels 35 can be configured with a contact width of between about 1-4 inches, typically about 3 inches. The wheels 35 may have a diameter of between 8-14 inches, typically between 10-12 inches. As noted above, the apparatus 10 can include a plurality of wheels 35, typically between about 2-10. More contact spots (more wheels) may increase the ease of flow of the sleeve of material 60 onto the chute body. The wheels 35 may be generally or substantially equidistantly spaced about the chute body to abut the chute at a generally common axial location during the shirring process. In other embodiments, the wheels may be staggered axially and/or more closely (irregularly) spaced.

In the embodiment shown, the wheels 35 have a Generally planar gripping surface profile. However, a contoured or grooved surface may be employed. In some embodiments, the gripping surface comprises a urethane material. In other embodiments, the outer surface may be a surface treated (coated, embossed, etc.) metal. Other gripping surfaces, configurations, and materials (typically polymer or ceramic) may be used.

In some embodiments, the apparatus 10 employs four or fewer wheels that converge from different (transverse or circumferential) locations to contact a cross-sectional perimeter shape of the chute and the cross-sectional shape can be non-circular.

FIG. 4A illustrates an exemplary start of the home position of the rail 50 and wheels 35. FIG. 5 illustrates an exemplary lowermost stop position of the rail 50 and wheels 35. Either or both of the home and "stop" locations can be adjusted by a user (typically via programmatic selection or input) according to a chute configuration or a desired loading length. The wheels 35 are shown in FIG. 5 as being generally flat or truncated at the chute contact edge. The wheels 35 are shown in this configuration for a discussion of operation and is intended to represent that the wheels 35 snugly abut the chute 20 at a stroke distance that is less than their respective total inward stroke distances, but is not intended to mean that the wheels 35 will necessarily be flat at the contact locations against the chute (although they may compress slightly depending on the wheel material employed and/or the contact pressure used).

Figure 6A:
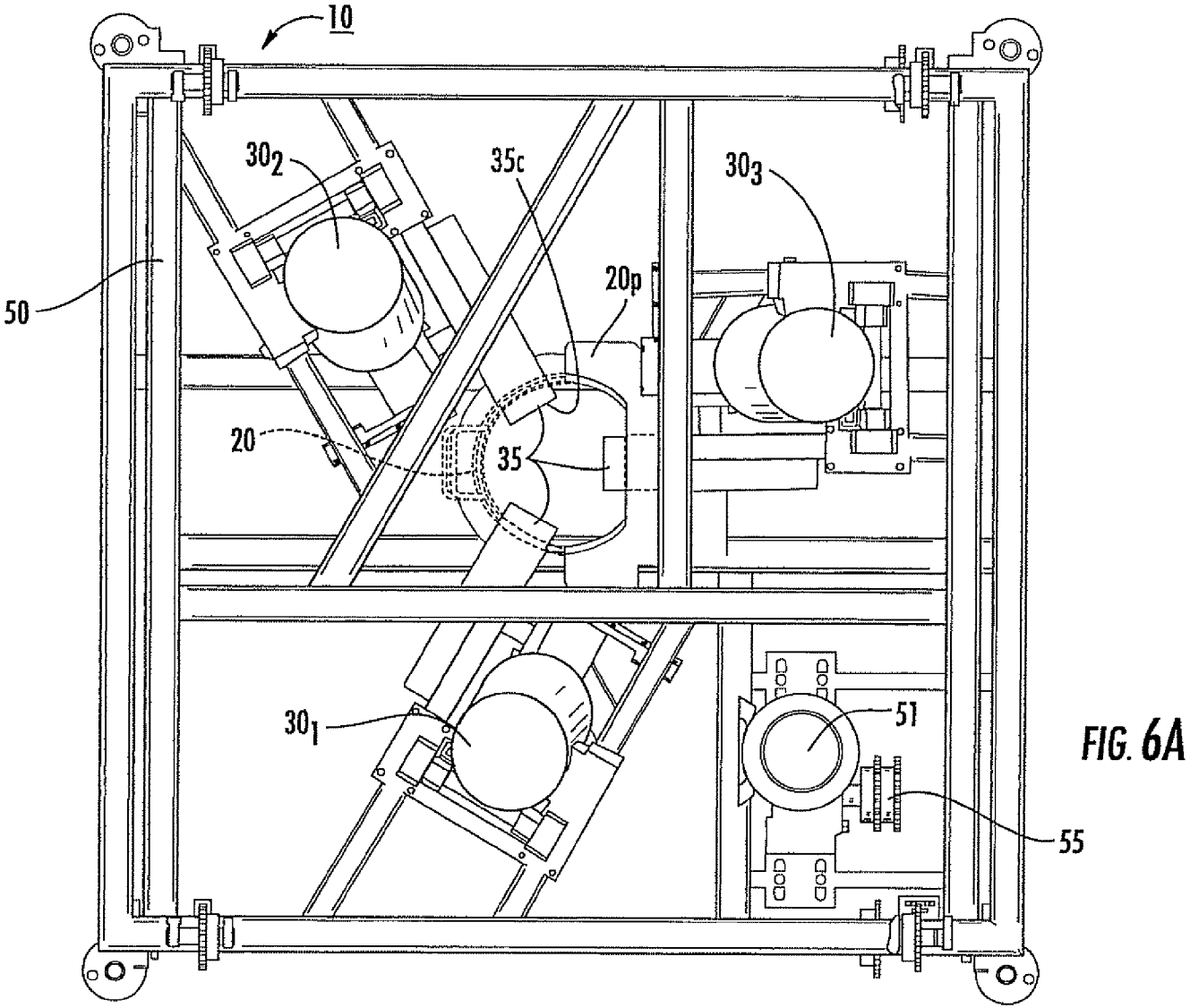
FIG. 6A is a top view of the rucker shown in FIG. 4A.
Figure 6B:
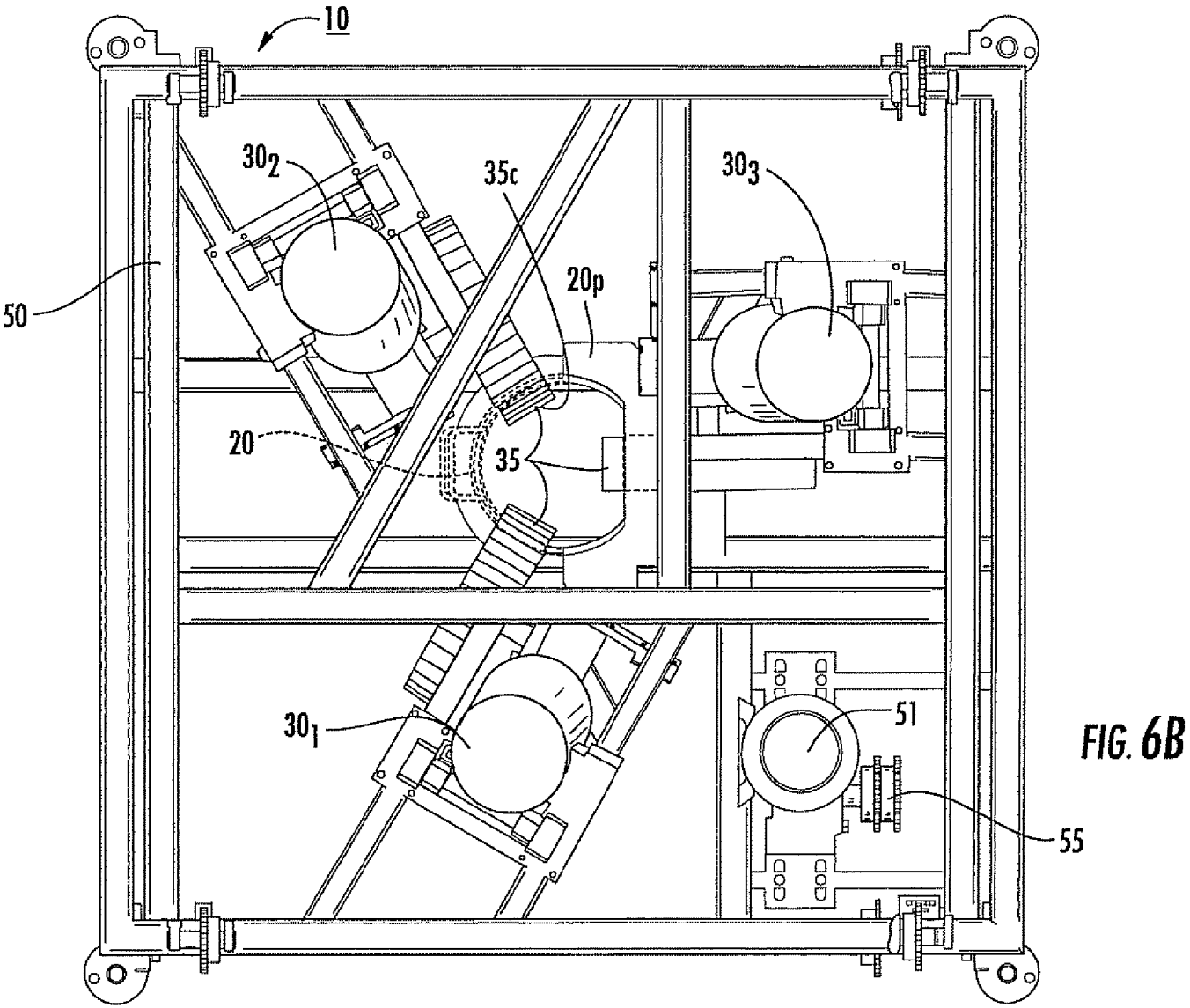
FIG. 6B is a top view of the rucker shown in FIG. 4C.

In the embodiment shown, the wheels are pivotably mounted at a pivot 50*p* to (and suspended from) the rail 50 (compare FIG. 4A, in which the wheels are retracted to FIG. 5, in which the wheels are pivotably extended). FIG. 6A is a top view of the apparatus 10 with the chute 20 shown primarily in phantom line about the wheels 35. It will be appreciated that, in operation, the chute 20 would stop the wheels 35 from actually advancing to the location shown. However, in FIG. 6A (and 6B), the chute 20 is shown in phantom (as indicated by the broken line illustration) with the wheels 35 extending beyond the bounds of the chute into a interior axial space of the apparatus 10.

Although the rail 50 is shown above the wheels 35, in other embodiments, the wheels 35 may be arranged to extend above the rail (not shown). Similarly, although shown as a single drive system with a common mounting rail 50, individual drive systems and/or mounting rails or frames may be used (not shown).

The wheel assemblies 301, 302, 303 can also include a worm gear 33 (FIG. 4B shown) that rotates the wheel in the second axial direction and inhibits rotation of the wheel 35 when the wheel 35 travels axially in a first direction along the primary axis of movement 10 (also in line with the chute axial centerline 20*a*). A suitable worm gear is a Winsmith worm gear available from Baldor Motors (epoxy coated to allow for wash down in a food processing plant) of Phoenix, Ariz. The worm gears are configured so that the worm can easily turn the gear, but the gear cannot turn the worm. This is because the angle on the worm is so shallow that when the gear tries to spin it, the friction between the gear and the worm holds the worm in place. This design can be useful to provide a locking feature that can act as an anti-rotation device when the motor is not turning.

The stroke length of wheel translation along the axis of movement 10*a* can be adjustable so as to distribute lengths of the covering over a desired length of a target chute, which may vary by chute and/or covering type.

The rucker 10 can be configured to inhibit operation until the chute 20 is in proper position and an access door of a housing 42 is closed (not shown but is conventionally used to enclose most operational components). An operator switch can be used to initiate operation. In other embodiments, the rucker 10 can be configured to automatically initiate operation when the chute 20 is loaded (which can be automatically electronically confirmed using a proximity sensor and/or other position sensor and/or when the air lock 44 is engaged) and the door closed.

Figure 7:
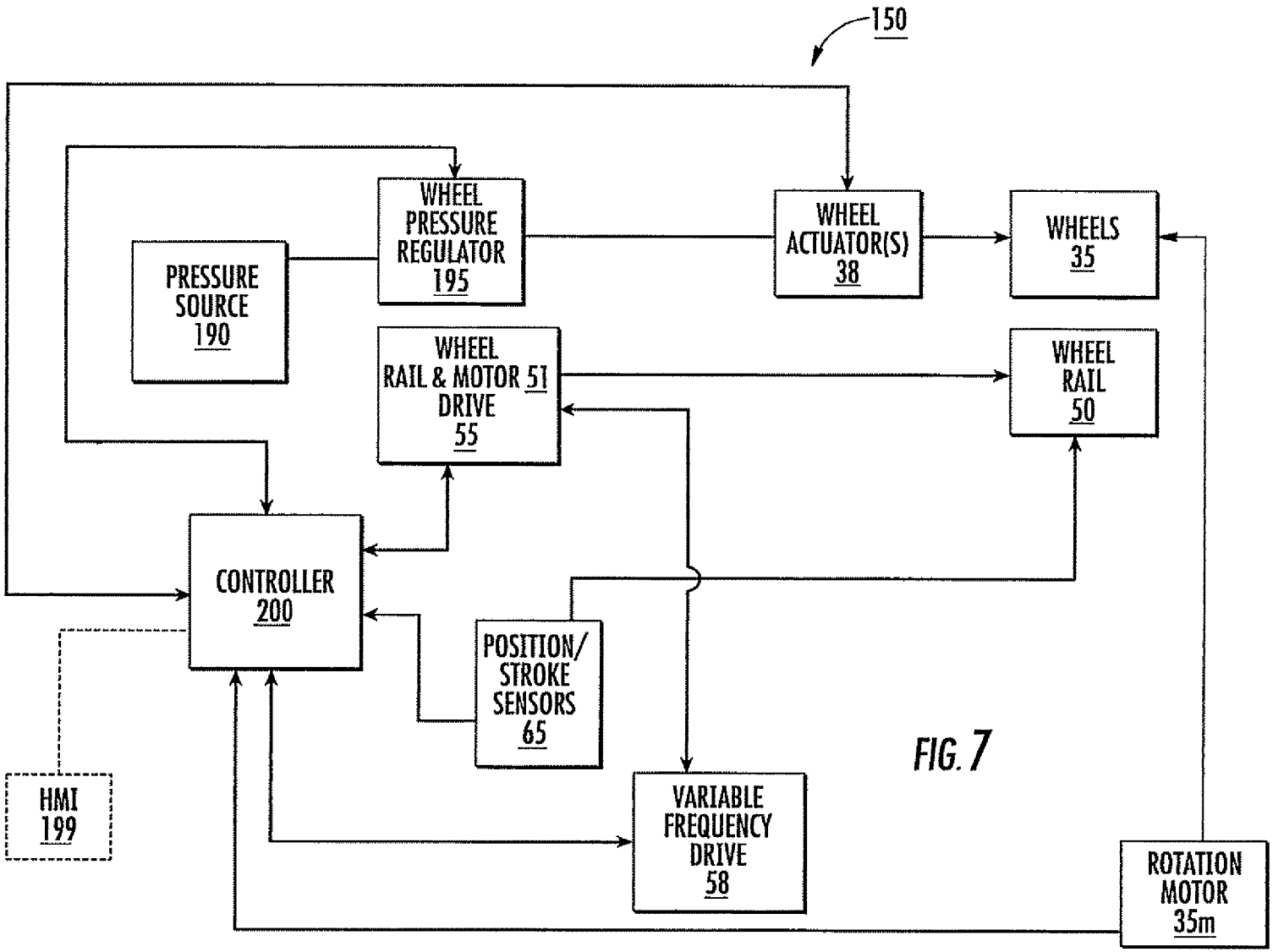
FIG. 7 is a schematic diagram of an automated or semi-automated rucker according to embodiments of the present invention.

FIG. 7 illustrates an exemplary control/operational diagram 150 according to embodiments of the present invention. As shown, a controller 200 can communicate with the wheels 35 and the drive system 55. The controller 200 can be configured to control the desired axial (upward and downward) translation speed of the wheels 35 (via rail 50) using a variable frequency drive 58 in communication with the drive system 55 (and/or motor 51). The controller 200 can also direct the actuation and stroke distances of the actuation cylinders 38 of the wheels 35 (together or independently). The controller 200 can also activate and deactivate the motors 35*m* that rotate the respective wheels 35. As shown, the system 150 can also include a pressure source 190 in communication with at least one wheel pressure regulator 195 that is in communication with the wheel actuators 38. In some embodiments, the regulator 195 can be configured to provide between about 30-80 psi to the actuators 38, and typically sufficient pressure to cause the wheels to snugly abut the chute 20 (between about 40-60 psi of pressure).

As also shown, the system 150 can communicate with at least one position sensor 65 that defines the location of the wheel/rail.

The system 150 may also include a user interface, typically a Human Machine Interface (HMI) 199. A user may be able to select desired speeds, stroke distances, wheel rotation rpm, and the like. Alternatively, the system 150 may be configured to allow a user to select a covering type, a chute type, a loading length, a wheel contact configuration, or other predetermined parameters and the system 150 can define the operational parameters (speed, stroke distance and the like).

The apparatus 10 can be configured to accommodate different size and/or shape chutes 20 with minimal set-up time.

The controller 200 can be configured (typically at an OEM site, but can be field upgraded) with different running program modules (which may vary speed, stroke distance, gripping pressure, timing and the like) depending on the running configuration of the chute, wheel configuration and/or covering material.

The wheels 35 can be cooperating members that are spaced apart and disposed generally opposing each other across the axis of movement. As discussed above, the cooperating wheels 35 may travel through their respective automated stroke cycles (inward toward the chute 20, down and up along the chute body and back to home and with the rotation starting concurrently) substantially in concert with each other.

Figure 8:
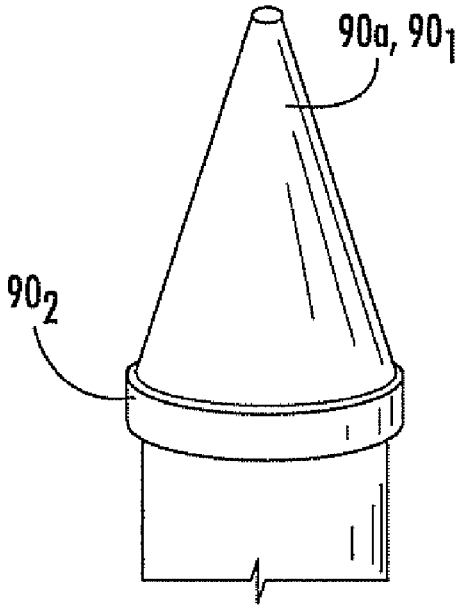
FIG. 8 is a schematic front view of a loading cap mounted to a chute body according to embodiments of the present invention.
Figure 9:
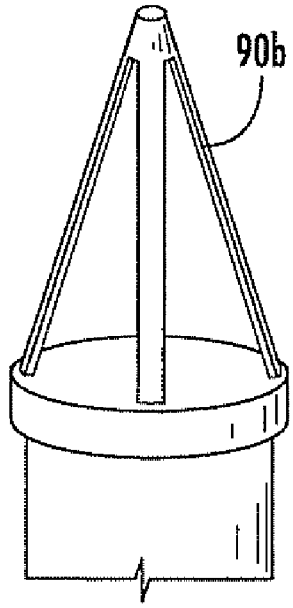
FIG. 9 is a schematic front view of an alternative loading cap according to embodiments of the present invention.
Figure 10:
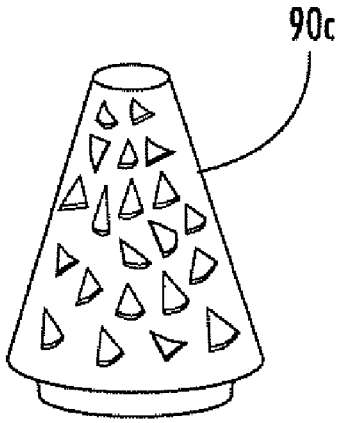
FIG. 10 is a schematic front view of another embodiment of a loading cap according to embodiments of the present invention.
Figure 11:
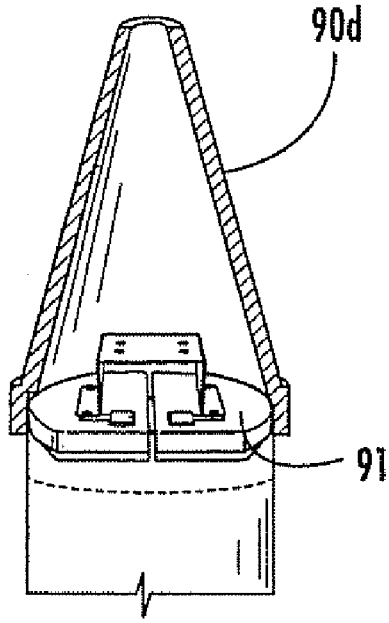
FIG. 11 is a schematic front view of another embodiment of a loading cap according to embodiments of the present invention.

FIGS. 8-11 illustrate generally conical loading caps 90 sized and configured to reside inside (or a small distance over the outside) of the chute 20 and extend above a first end of the chute 20 to help guide the covering material 60 over the chute body (particularly away from any sharp or blunt leading edges). In FIGS. 8-11, the loading caps are each generally designated by element number 90 with particular embodiments having a suffix noted in the respective figures. FIG. 8 illustrates a continuous body cap 90*a*. FIG. 9 illustrates a cap 90*b* with a non-continuous body (having opening spaces). FIG. 10 illustrates a cap 90*c* with a mesh body and also illustrates an open end portion (frustoconical). Combinations of the features shown with respect to different embodiments may be used. The loading cap 90 can be a metallic (such as stainless steel) or elastomeric (typically polymeric) generally hollow body with either an open or closed upper and lower end. It should be sufficiently rigid to support its own weight and to separate the covering material from a flat sleeve of a first diameter into an open sleeve closely matching the cross-sectional area of the chute 20. The first end portion $\mathbf{90}_1$ of the cap has a substantially smaller cross-sectional width than the second end portion $\mathbf{90}_2$. The first end portion $\mathbf{90}_2$ may have a width that is less than about 2 inches and the second end portion $\mathbf{90}_2$ may have a width that is at least about 12 inches, typically at least about 24 inches. The cap 90 may have a length that is about 5-20 inches, typically between about 6-18 inches and may reside inside the chute body as shown in FIG. 10 or may reside outside the chute body as shown in FIGS. 8 and 9. FIG. 11 illustrates that the cap 90 may attach to an intermediate loading cap 91 that mounts to the chute 20.

Figure 12A:
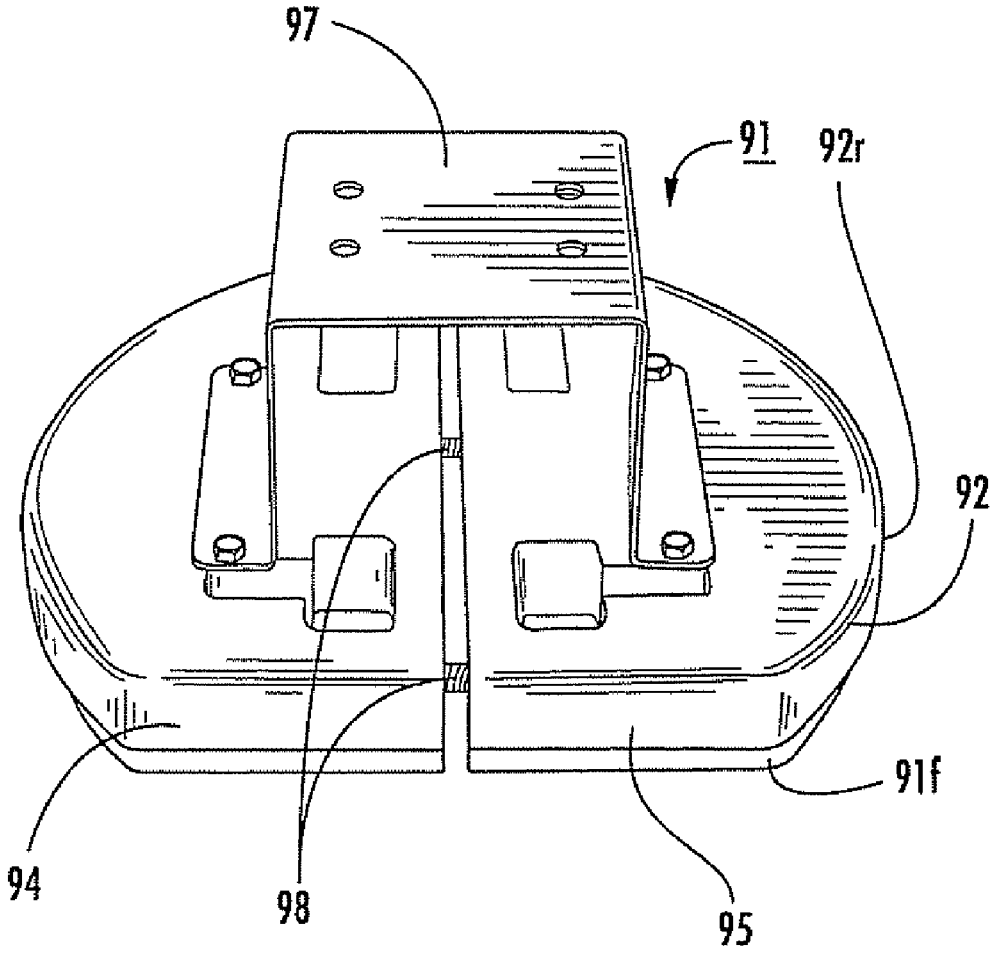
FIG. 12A is a top perspective view of a spring-loaded insert of a loading cap that may be used with elongate loading caps according to embodiments of the present invention.
Figure 12B:
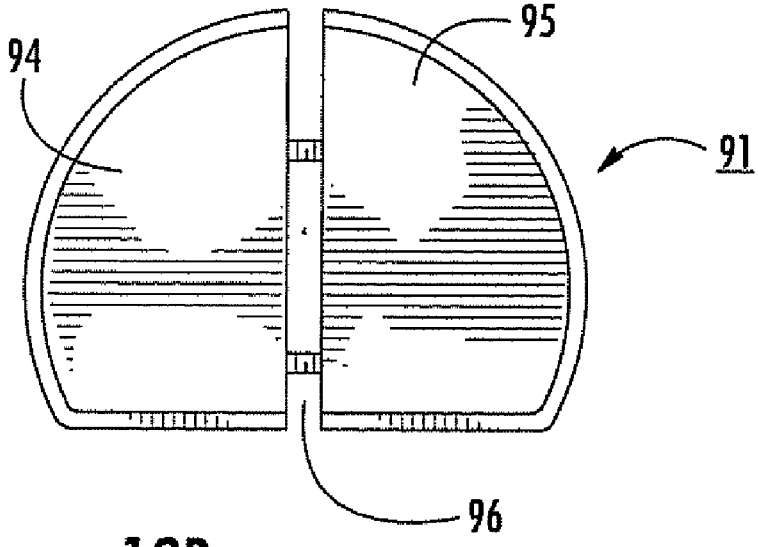
FIG. 12B is an end view of the insert shown in FIG. 12A.

As shown in FIGS. 12A and 12B, the intermediate loading cap 91 can have a first internal portion $\mathbf{91}_f$ that is sized and configured to reside a distance inside the chute 20 and a second external portion 92 overlying the first portion 91 with an increased cross-sectional area sufficient to cause the outer edge portions thereof to reside outside the bounds of the first end of the chute 20. The second portion 92 of the intermediate loading cap 91 can have rounded outer edges 92*r* that contact covering material 60 being pulled over the chute 20 to inhibit contact with the edge of the chute 20. The intermediate loading cap 91 can have a primary body that comprises a polymer such as Delrin® acetal homopolymer.

As shown in FIGS. 12A and 12B, the intermediate loading cap 91 can have a non-circular (cross-section) perimeter shape while the loading cap 90 may have a circular (cross-section) shape. In some embodiments, the intermediate loading cap 91 comprises spaced apart first and second members 94, 95 with a generally medial gap 96 therebetween. The first and second members 94, 95 can be spring loaded (98) to be able to compress or move side to side between an expanded configuration before insertion into the chute 20 and a compressed position when in operative position in the chute 20 to snugly reside in the end portion of the chute 20 abutting the inner wall thereof. The intermediate loading cap 91 can also include an upwardly extending handle 97 that is attached to the first member 94 and the second member 95. As also shown, the first member 94 and second member 95 can be configured to be substantial mirror images of each other and define the intermediate loading cap 91 with a generally arcuate profile portion that merges into a generally planar portion.

Figure 14A:
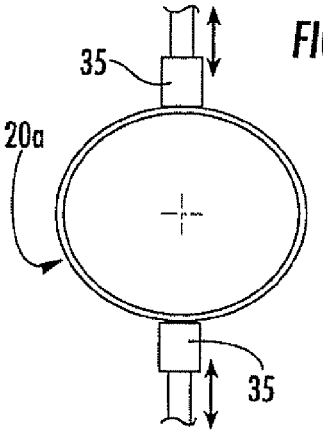
FIGS. 14A-14G are schematic illustrations of exemplary alternative wheel arrangements and alternative chute profile configurations according to embodiments of the present invention.
Figure 14B:
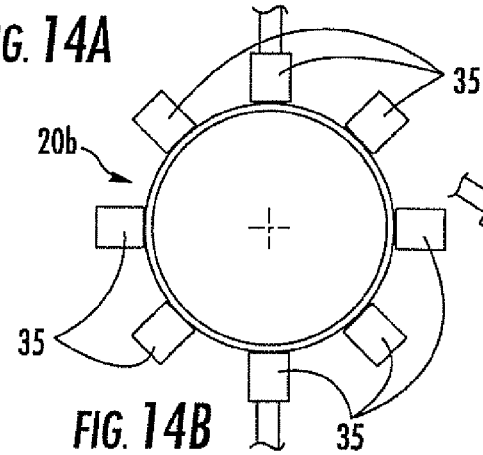
Figure 14C:
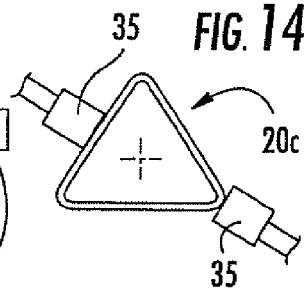
Figure 14D:
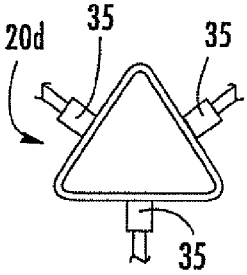
Figure 14E:
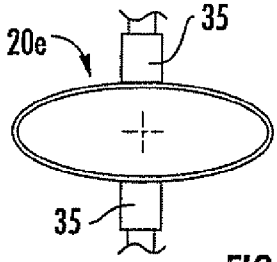
Figure 14F:
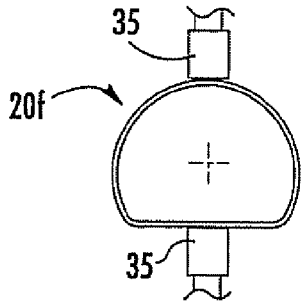
Figure 14G:
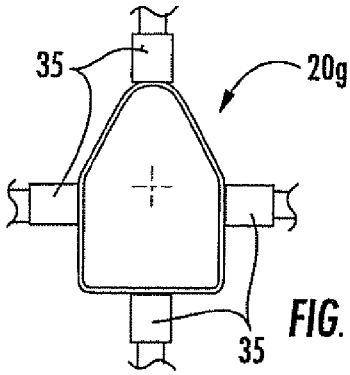

FIGS. 14A-14G illustrate different exemplary arrangements of wheels 35 and different examples of configurations of chutes 20*a*-20*g*, respectively. FIGS. 14A, 14C, 14E and 14F illustrate the use of two wheels 35 configured to accommodate different chute cross-sectional shapes. FIG. 14D illustrates the use of three wheels 35, FIG. 14G illustrates the use of four wheels 35, and FIG. 14B illustrates the use of eight wheels 35. Combination of the arrangements shown can be used as well as different numbers of wheels can be used for different chute configurations.

In some embodiments, the apparatus 10 can be configured to serially accept different rails 50, each having a desired wheel arrangement that operates with a desired chute 20. Accordingly, embodiments of the present invention can accommodate differently shaped chutes, different wheel arrangements, different wheel contact pressures, different stroke lengths for different length chutes, different coverings, different wheel rotation speeds and axial movement speeds, and the like.

As discussed above, FIG. 13 illustrates that the operative orientation of the chute 20 can be non-vertical, such as horizontal, with the wheels 35 configured to axially translate substantially horizontally.

The operation and/or sequence of events may be programmatically controlled by a programmable logic controller.

Figure 15:
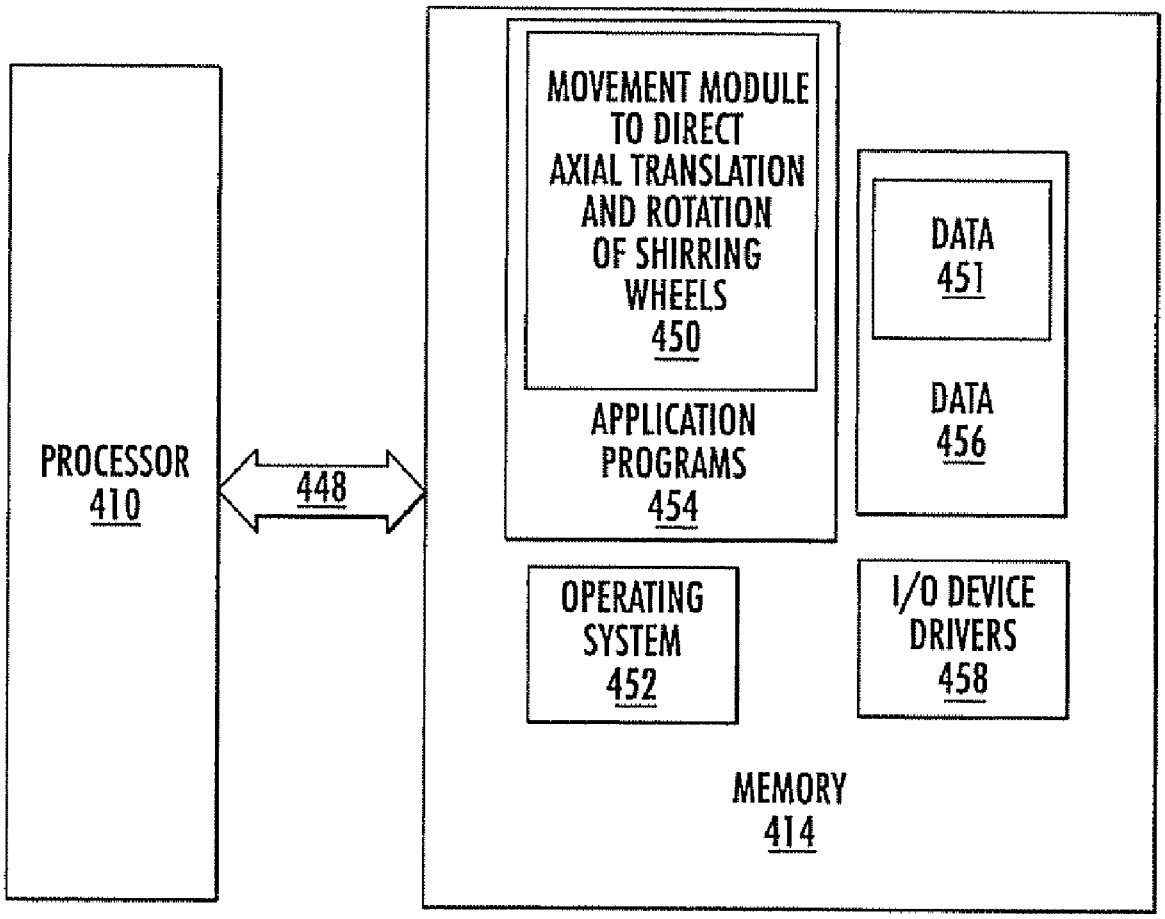
FIG. 15 is a block diagram of a data processing system/computer program according to embodiments of the present invention.

FIG. 15 is a block diagram of exemplary embodiments of data processing systems that illustrates systems, methods, and computer program products in accordance with embodiments of the present invention. The data processing systems may be incorporated in a programmable logic controller and/or be in communication therewith. The processor 410 communicates with the memory 414 via an address/data bus 448. The processor 410 can be any commercially available or custom microprocessor. The memory 414 is representative of the overall hierarchy of memory devices containing the software and data used to implement the functionality of the data processing system. The memory 414 can include, but is not limited to, the following types of devices: cache, ROM, PROM, EPROM, EEPROM, flash memory, SRAM, and DRAM.

As shown in FIG. 15, the memory 414 may include several categories of software and data used in the data processing system: the operating system 452; the application programs 454; the input/output (I/O) device drivers 458; Movement Module to Direct Axial Translation And Rotation of Shirring Wheels 450; and the data 456.

The data 451 may include a look-up chart of cycle times, synchronization data, wheel speed, rpms, different coverings, different chutes, covering material lengths, sensor (wheel or rail position) feedback, safety interlock circuits and the like 456 corresponding to particular or target products for one or more producers, which may allow an operator to select certain operational parameters at the start of each shift, each rucking cycle, and/or production run and the like.

As will be appreciated by those of skill in the art, the operating system 452 may be any operating system suitable for use with a data processing system, such as OS/2, AIX, DOS, OS/390 or System390 from International Business Machines Corporation, Armonk, N.Y., Windows CE, Windows NT, Windows95, Windows98 or Windows2000 from Microsoft Corporation, Redmond, Wash.; Unix or Linux or FreeBSD, Palm OS from Palm, Inc., Mac OS from Apple Computer, LabView, or proprietary operating systems. The I/O device drivers 458 typically include software routines accessed through the operating system 452 by the application programs 454 to communicate with devices such as I/O data port(s), data storage 456 and certain memory 414 components. The application programs 454 are illustrative of the programs that implement the various features of the data processing system and preferably include at least one application, which supports operations according to embodiments of the present invention. Finally, the data 456 represents the static and dynamic data used by the application programs 454, the operating system 452, the I/O device drivers 458, and other software programs that may reside in the memory 414.

While the present invention is illustrated, for example, with reference to the Module 450 being an application program in FIG. 15, as will be appreciated by those of skill in the art, other configurations may also be utilized while still benefiting from the teachings of the present invention. For example, the Module 450 may also be incorporated into the operating system 452, the I/O device drivers 458 or other such logical division of the data processing system. Thus, the present invention should not be construed as limited to the configuration of FIG. 15, which is intended to encompass any configuration capable of carrying out the operations described herein.

The I/O data port can be used to transfer information between the data processing system, the locking member, the translating member, the gripping members and/or another computer system or a network (e.g., the Internet) or to other devices controlled by the processor. These components may be conventional components such as those used in many conventional data processing systems that may be configured in accordance with the present invention to operate as described herein.

In some embodiments, the Module 450 is configured to allow a user to select certain parameters associated with a desired rucking stroke cycle. For example, a user can select a desired repetition frequency (speed), wheel rotation speed, wheel contact force, axial stroke length or actuation stroke distance, and the like.

The data 456 may include a look-up chart of different parameters (i.e., for a type of netting, selectable length and the like) corresponding to particular or target products for one or more producers. The data 456 may include data from a proximity sensor and/or exhaustion of a sleeve of material detector that allows the computer program to automatically control the operation of the rucker.

For example, certain embodiments of the present invention are directed to a computer program product in a computer readable medium with: (a) computer readable program code configured to direct the axial movement of a plurality of wheels to automatically move in opposing directions about an axis of movement single stroke cycle over a rucking operation; and (b) computer readable program code configured to direct the wheels to rotate only when they are axially moving in the second direction.

The computer readable program code that is configured to provide adjustable stroke cycles can be configured to provide a plurality of pre-programmed different selectable parameters as discussed above.

While the present invention is illustrated, for example, with reference to particular divisions of programs, functions and memories, the present invention should not be construed as limited to such logical divisions. Thus, the present invention should not be construed as limited to the configuration of FIG. 15 but is intended to encompass any configuration capable of carrying out the operations described herein.

The flowcharts and block diagrams of certain of the figures herein illustrate the architecture, functionality, and operation of possible implementations of embodiments of the present invention. In this regard, each block in the flow charts or block diagrams represents a module, segment, or portion of code, which comprises one or more executable instructions for implementing the specified logical function(s). It should also be noted that in some alternative implementations, the functions noted in the blocks may occur out of the order noted in the figures. For example, two blocks shown in succession may in fact be executed substantially concurrently or the blocks may sometimes be executed in the reverse order, depending upon the functionality involved.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. In the claims, means-plus-function clauses, where used, are intended to cover the structures described herein as performing the recited function and not only structural equivalents but also equivalent structures. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

That which is claimed is:

1. An apparatus for rucking sleeves of covering material onto a chute body, comprising:

a plurality of spaced apart rotatable wheels having a primary axis of movement, wherein, in operation, the plurality of wheels have an automated stroke cycle adapted to cause each wheel to travel inwardly a distance sufficient to snugly abut an outer surface of a chute body and remain in contact with the chute body while the wheels travel in a first direction about the primary axis of movement and in an opposing second direction about the primary axis of movement.

2. An apparatus according to claim 1, wherein the wheels rotate as they travel in the second direction but do not rotate as they travel in the first direction, and wherein the first direction is a downward direction and the second direction is an upward direction.

3. An apparatus for rucking sleeves of covering material onto a chute body, comprising:

a plurality of spaced apart rotatable wheels having a primary axis of movement, wherein, in operation, the plurality of wheels have an automated stroke cycle whereby each is configured to travel inwardly a distance sufficient to snugly abut an outer surface of a chute body and remain in contact with the chute body while the wheels travel in a first direction about the primary axis of movement and in an opposing second direction about the primary axis of movement; and a variable speed drive in communication with the wheels, wherein the wheels move at first speed in the first direction of travel about the primary axis of movement and at a second speed different from the first speed in the second direction of travel about the primary axis of movement.

4. An apparatus according to claim 1, wherein the wheels travel substantially in concert about the primary axis of movement once in each direction to finish a single shirring operation whereby the chute is loaded with the sleeve of covering material.

5. An apparatus according to claim 1, further comprising a translating mounting rail, the translating mounting rail being configured to reciprocally move a distance that is at least a major portion of a chute body length about the primary axis of movement, and wherein the wheels are mounted to the mounting rail.

6. An apparatus for rucking sleeves of covering material onto a chute body, comprising:

a plurality of spaced apart rotatable wheels having a primary axis of movement, wherein, in operation, the plurality of wheels have an automated stroke cycle whereby each is configured to travel inwardly a distance sufficient to snugly abut an outer surface of a chute body and remain in contact with the chute body while the wheels travel in a first direction about the primary axis of movement and in an opposing second direction about the primary axis of movement; and a translating mounting rail, the translating mounting rail being configured to reciprocally move a distance that is at least a major portion of a chute body length about the primary axis of movement, and wherein the wheels are mounted to the mounting rail, wherein the wheels are pivotably mounted to the mounting rail and are operably associated with a respective actuation cylinder, and wherein the wheels extend a distance below the mounting rail to be able to pivot inwardly toward a centerline of the apparatus a distance that is less than a stroke distance to snugly abut the chute body, then outwardly away from the centerline of the apparatus in a home or non-use position.

7. An apparatus according to claim 1, wherein the primary axis of movement is substantially a vertical axis of movement.

8. An apparatus according to claim 7, wherein the primary axis of movement is a substantially a horizontal axis of movement.

9. An apparatus according to claim 1, further comprising a stationary chute platform residing at a fixed lower portion of a housing enclosing the horn and wheels, the platform configured to hold the chute body in a fixed position in the apparatus as the wheels move in the first and second directions about the primary axis of movement.

10. An apparatus for rucking sleeves of covering material onto a chute body, comprising:

a plurality of spaced apart rotatable wheels having a primary axis of movement, wherein, in operation, the plurality of wheels have an automated stroke cycle whereby each is configured to travel inwardly a distance sufficient to snugly abut an outer surface of a chute body and remain in contact with the chute body while the wheels travel in a first direction about the primary axis of movement and in an opposing second direction about the primary axis of movement; and a respective worm gear in communication with each wheel whereby the wheels are inhibited from rotating upon contact with the chute body as the wheels travel in the first direction.

11. An apparatus according to claim 1, wherein each wheel has an outer surface configured with frictional properties sufficient to grip the covering material and pull the covering material down over the chute as the wheels travel in the first direction about the primary axis of movement and to pull additional covering material over the chute body as the wheels rotate and travel in the second direction about the primary axis of movement.

12. An apparatus according to claim 11, wherein the outer surface is elastomeric.

13. An apparatus according to claim 1, wherein the wheels rotate at between about 50-70 rpm.

14. An apparatus according to claim 1, wherein the wheels have a diameter of between about 8-14 inches.

15. An apparatus for rucking sleeves of covering material onto a chute body, comprising:

a plurality of spaced apart rotatable wheels having a primary axis of movement, wherein, in operation, the plurality of wheels have an automated stroke cycle whereby each is configured to travel inwardly a distance sufficient to snugly abut an outer surface of a chute body and remain in contact with the chute body while the wheels travel in a first direction about the primary axis of movement and in an opposing second direction about the primary axis of movement, wherein the wheels are configured to pivot inward toward the axis of movement in concert and apply a substantially similar contact pressure to the chute, the pressure being between about 40-60 psi.

16. An apparatus according to claim 1, wherein the wheels are configured to ruck at least about 100 feet of covering material onto the chute body in less than about 1 minute.

17. An apparatus according to claim 16, wherein the wheels are configured to ruck about 120 feet of covering material onto the chute body in about 40 seconds or less.

18. An apparatus according to claim 1, further comprising an elongate loading cone configured to extend out of a first end portion of the chute body.

19. An apparatus according to claim 1, further comprising a sleeve of fixed-diameter covering material in communication with the chute body.

20. An apparatus according to claim 1, further comprising a sleeve of elastically expandable-diameter covering material in communication with the chute body.

21. An apparatus for rucking sleeves of covering material onto a chute body, comprising:

a plurality of spaced apart rotatable wheels having a primary axis of movement, wherein, in operation, the plurality of wheels have an automated stroke cycle whereby each is configured to travel inwardly a distance sufficient to snugly abut an outer surface of a chute body and remain in contact with the chute body while the wheels travel in a first direction about the primary axis of movement and in an opposing second direction about the primary axis of movement;

an automated wheel drive system in communication with the wheels;

a variable speed drive in communication with the drive system;

a control module in communication with the variable speed drive;

a plurality of actuation cylinders, one for each wheel in communication with the control module; and a pressure regulator in communication with the actuation cylinders, wherein, in operation, the control module directs the wheels to pivot inwardly to contact the chute body, translate down at a first speed, rotate when the wheels reach a lower portion of the chute body, then translate up at a second speed, that is slower than the first speed while the wheels rotate.

22. An apparatus according to claim 21, further comprising a housing with a frame configured to enclose the product chute therein during operation, wherein the apparatus has a height that is about 6.5 feet or less and is configured to accept product chutes having a loading length that is between about 3-4 feet.

23. A rucker, comprising:

a housing enclosing a frame supported by a floor, the housing having a height of about 8 feet or less;

a platform affixed to a lower portion of the frame in a stationary manner, the platform configured to releasably hold a chute body for rucking netting thereon;

a plurality of spaced apart rotatable wheels supported by a rail movably supported by the frame, the rail having a vertical axis of movement; and a drive system with an automated stroke cycle in communication with the wheels, wherein, in operation, the drive system drives the plurality of wheels using an automated stroke cycle that directs each wheel to travel inwardly a distance sufficient to snugly abut an outer surface of the chute body and remain in contact with the chute body while the wheels travel in one of a downward or upward first direction and in an opposing one of an upward or downward second direction to ruck netting material onto the chute body while the chute body resides in a fixed position in the housing on the platform.

24. The rucker of claim 23, wherein the chute body is held entirely inside the housing during operation.

25. The rucker of claim 23, wherein the housing has a height of about 6.5 feet or less and the chute body is held entirely inside the housing during operation.

* * * * *